United States Patent [19]

Egri

[11] Patent Number: 4,646,760

[45] Date of Patent: Mar. 3, 1987

[54] METHOD AND APPARATUS FOR THE VOLUME EXPANSION OF TOBACCO

[75] Inventor: Laszlo Egri, Basel, Switzerland

[73] Assignee: Tamag Basel AG, Birsfelden, Switzerland

[21] Appl. No.: 417,548

[22] Filed: Sep. 13, 1982

[30] Foreign Application Priority Data

Sep. 16, 1981 [DE] Fed. Rep. of Germany ..... 3136842

[51] Int. Cl.[4] ..... A24B 3/18

[52] U.S. Cl. ..... 131/296

[58] Field of Search ..... 131/296, 303, 304, 305, 131/306, 307

[56] References Cited

U.S. PATENT DOCUMENTS 4,044,780 8/1977 Kelly ..... 131/303

*Primary Examiner*—V. Millin

*Attorney, Agent, or Firm*—Cohen, Pontani & Lieberman

[57] ABSTRACT

A method and apparatus for carrying out the volume-expansion (puffing) of disintegrated tobacco, wherein said tobacco is impregnated with an impregnating medium containing water and/or orthophosphoric acid and/or the sodium or ammonium salts thereof and/or ammonium sulphate to an initial moisture content of at least about 35% by weight, and is then reduced to a final moisture content of about 10–13% by weight with the aid of a heating medium containing gaseous water vapor, the overall duration of the method being at least about 10 seconds. The method according to the invention is carried out as a continuous two-step process including a first process step during which the impregnated tobacco's moisture content is reduced by about 5% to about 60% of its initial moisture content under standard puffing conditions, and a second less severe process step, during which the tobacco is subjected to a flow of heating medium and/or mechanically conveyed under moderated process conditions as compared to the puffing conditions, and at a lower temperature, to attain a final moisture content of about 10% to 13% by weight.

55 Claims, 7 Drawing Figures

METHOD AND APPARATUS FOR THE VOLUME EXPANSION OF TOBACCO

TECHNICAL FIELD

This invention relates to a method and apparatus for the volume-expansion (puffing) of disintegrated cut tobacco.

BACKGROUND ART

A method for improving the filling power of cut and impregnated tobacco is demonstrated in U.K. Pat. No. 1,409,825. According to this method, a volume expansion of the impregnated tobacco may be achieved by inducing a rapid pressure change in the surrounding medium. However, such batch methods are rather uneconomical.

Alternative methods for improving the filling power of cut and impregnated tobacco involve heating it with the aid of a gaseous heating medium, after first impregnating the cut tobacco and water, or in the case of cut tobacco laminae, impregnating the tobacco with an organic or inorganic impregnating composition having a low boiling and/or evaporation temperature.

Various heating mediums have been employed in the prior art. For example, U.S. Pat. Nos. 3,409,022 and 3,409,023 discloses employing air or inert gas without any appreciable moisture content as the heating medium for volume expansion. However, in these methods the cut surfaces of the tobacco particles tend to form a crust preventing an elastic yielding of the outer cells or cell walls. This crust hinders the desired puffing of the tobacco.

Various contact times of the heating medium with tobacco during the volume expansion process have also been employed. For example, U.S. Pat. No. 3,357,436 specifies an extraordinarily extended contact period and employs several drying towers in the process. This results in a minimal volume increase of about 2–3%.

Conversely, U.S. Pat. No. 3,734,104 and DE Pat. No. 2253882 disclose using a contact period of only 0.5 to no more than 3 seconds in a gaseous vapor-containing heating medium in which cut and moistened tobacco stems are rapidly dried down to a moisture content of 6%. These methods result in an initial filling power increase of about 50%.

The heating medium employed for conveying and drying the tobacco has a velocity of about 40 meters per second. In order to achieve the desired contact period, or dwell time, this high velocity necessitates excessively long tubing systems. This results in a considerable pressure drop and correspondingly high energy requirements.

These types of systems also result in considerable waste since it is impossible to avoid fracturing of the tobacco particularly at the bends of the tubing systems as well as on separating the tobacco from the heating medium. The tobacco which is extremely dry and very brittle undergoes a considerable loss of quality.

In addition, prior to further processing, the tobacco's moisture content has to be raised to the customary value of 12–13%, and the initially achieved filling power improvement is effectively reduced unless extensive measures are taken to avoid this occurrence.

Similarly, in European Patent Application No. 0029588, the impregnated tobacco is expanded and dried by means of a fast flowing heating medium within a tubing system having 90° bends and employing a maximum contact time of three seconds prior to separation from the heating medium in a separator apparatus. Likewise, in this method, it is scarcely possible to avoid embrittlement of the tabacco, a large proportion of waste, and a loss of quality.

Another method for carrying out the volume expansion is disclosed in U.S. Pat. No. 3,881,498. Here, the tobacco is agitated in a vibrating fluidized bed. The heating medium enters the bed through perforations. However, the flow velocity of the gas stream is limited by the floating capability of the tobacco particles, whereby the puffing effect is diminished. Furthermore, channeling may occur in the fluidized bed of tobacco particles, leading to irregular moisture distribution and non-uniform puffing.

In all of these prior art methods, the initial moisture content of the tobacco lies above 35%. The volume expansion is conducted in a single process step under practically constant conditions. Cyclones are employed for separating the air from the tobacco and/or for uniform drying. The final moisture content of the tobacco following such drastic processing conditions lies at about 2%, since the extreme puffing conditions are also maintained during drying. This results in the final quality of the tobacco being impaired and a large amount of waste.

An attempted improvement over these systems is described in U.S. Pat. No. 4,044,780 in which a tube is provided with gas inlets for conveying the tobacco in a stream of warm, moist air. Upstream of the outlet end, the tube is provided with a restriction effective to accelerate the flow and to create increased turbulence. This leads to better heat transfer during the drying of the tobacco but also results in the tobacco particles being subjected to increased fracturing due to turbulence and flow reversals under increased velocity while the tobacco is in a substantially dry state. This reduces the filling power improvement and creates a large proportion of dust.

SUMMARY OF THE INVENTION

The present invention offers a method and apparatus for the volume expansion and drying of cut tobacco which overcomes the disadvantages of the prior art by using a continuous two-step process. The tobacco, after being impregnated with an impregnating medium containing water, to an initial water content of at least 35% by weight, is then subjected to puffing and reduction of its moisture content to a final content of 10–13% by weight with the aid of a heating medium containing gaseous water vapor.

In the present method, tobacco is treated in the form of cut tobacco stems and/or cut tobacco leaves either separately or as a mixture.

The two-step process includes a first process step during which the impregnated tobacco's moisture content is reduced by about 5% to about 60% of its initial moisture content under puffing conditions. It has been unexpectedly found that more than 80% of the volume increase is already achieved in the first process step.

Basically, during the first process step, the impregnated tobacco is subjected to great amounts of heat in an extremely short time. This evaporates the impregnating medium within the cells without substantially drying the cell's surfaces or cell walls. Since the tobacco is still moist at the end of the first process step, it is able to withstand the high velocities therein without damage.

The further treatment of the tobacco in the second process step is carried out under much less severe conditions designed to merely adjust the moisture content of the tobacco to the level required for further processing. The more careful treatment of the increasingly dry tobacco in the second process step substantially prevents the occurrence of waste and quality losses. This is accomplished by a reduction of the linear velocity and temperature of the heating medium in the second process step. This also results in a corresponding reduction of the energy requirement for the process as well as reducing the tendency of the tobacco to fracture.

Accordingly, it is an object of the present invention to provide a method and apparatus for the volume expansion of cut tobacco which will serve to increase the filling power of the tobacco with very little waste and without noticeable quality losses.

BRIEF DESCRIPTION OF THE DRAWINGS

The novel features of the present invention along with the objects and advantages thereof will be better understood with reference to the following description considered in connection with the accompanying drawings in which several preferred embodiments are illustrated. However, it should be understood that the drawings are illustrative only and are not intended to define the scope of the invention.

BEST MODE FOR CARRYING OUT THE INVENTION

The method according to the present invention for the volume-expansion (puffing) of tobacco, particularly of cut tobacco ribs and/or cut tobacco leaves, may be carried out in apparatus substantially as shown in FIGS. 1–7.

Figure 1:
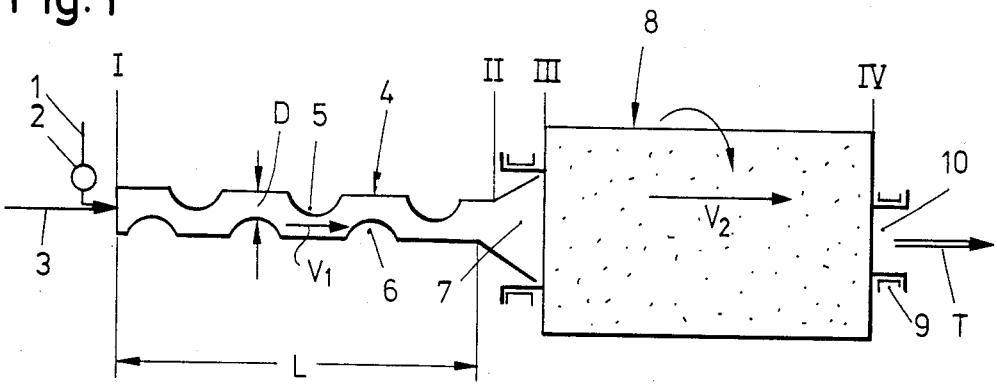
FIG. 1 is a schematic side elevational view of one embodiment of an apparatus employing the principles according to the present invention.

In the embodiment of FIG. 1 a feed duct 1 for the cut tobacco extends via a control device 2 to the inlet end I of a tubing system generally indicated at 4. A heating medium duct 3 is also connected to the inlet end I. The tubing system is formed of a plurality of juxtaposed tubes (not shown), the walls of which are formed with inwardly directed, rounded projections 5 and 6. Projections 5 and 6 are staggered in the longitudinal direction of tubing system 4 so as to form rounded obstacles or chicanes. Connected to the outlet end II of tubing system 4 is a funnel-shaped connecting section 7 forming a transition to a drying apparatus, in this case a drum dryer 8. The drum dryer 8 is rotatably mounted in bearings 9 and is rotated by rotary drive means (not shown). An outlet chute 10 is provided for discharging the fully treated tobacco T. Drum dryer 8 has an inlet end III and an outlet end IV.

In the preferred embodiment, tubing system 4 has an interior width D of 100–120 mm and a length L of between 2 and 3 m. The impregnated tobacco is blown into inlet end I of tubing system 4 by way of ducts 1 and 3. The tobacco/heating medium mixture moves therein towards outlet end II with a linear velocity V1. In the funnel-shaped divergent connector 7, the velocity is lowered to a speed of V2 in the drum dryer 8 in which the temperature of the heating medium is lowered as well.

The heating medium is effective to transfer heat and kinetic energy to the impregnated tobacco, whereby the impregnating medium contained in its cells is rapidly transformed to steam, resulting in a considerable volume increase. The impregnated tobacco has a predetermined initial moisture content, a predetermined proportion of which is removed therefrom by drying during the volume expansion taking place in tubing system 4, whereafter further moisture is extracated in drum dryer 8, until the tobacco T has a predetermined final moisture content at outlet chute 10.

The method for the volume expansion of the tobacco is carried out in two separate process steps, the first of which takes place in tubing system 4, while the second process step is carried out in drum dryer 8. In the first process step the still relatively moist (about 60%) tobacco is subjected to intensive turbulence, while a less severe drying action, in combination with reduced puffing effect, occurs in the second process step.

In the preferred embodiment, the overall duration of the processing lies between 10 seconds and 5 minutes, with the first process step being controlled in such a manner that it is finished within 1/10 of the overall duration.

The desired volume expansion is intended to improve the bulkiness of the treated tobacco with the treatment of the tobacco to be carried out in such a manner that no quality loss occurs and only a minimum proportion of waste in the form of tobacco dust and fines is produced.

Figure 2:
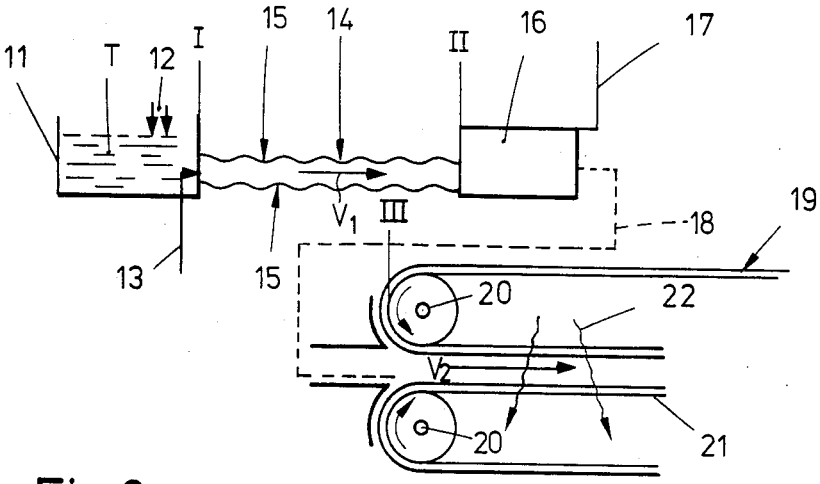
FIG. 2 is a schematic side elevational view of yet another embodiment of an apparatus employing the principles according to the present invention.

FIG. 2 shows another embodiment of apparatus for carrying out the method according to the present invention. In a container 11, a predetermined amount of cooked tobacco is moistened to a predetermined moisture content with an impregnating medium 12. Container 11 is located adjacent to inlet end I of a tubing system 14. Also connected to inlet end I is an inlet duct 13 for a heating medium. The interior walls of tubing system 14 are formed with rounded indentations 15, resulting in a wave-shaped cross-sectional configuration of tubing system 14. In execution of the method, a linear speed V1 is maintained in tubing system 14. Connected to the outlet end 11 of tubing system 14 is a separator 16 which may be of any suitable design. Separator 16 is further connected to a heating medium outlet duct 17 and a connecting duct 18 leading to a drying apparatus 19, in this instance a specially designed multiple-belt dryer comprising double mesh belts 21 guided over guide rollers 20. Belts 21 are driven at a speed V2, and a heating medium 22 is circulated transversely of the direction of movement of the belts. The inlet end of the drying apparatus is designated III.

In the apparatus of FIG. 2, the method according to the invention for the volume-expansion of tobacco is also carried out in two process steps, with separator 16 dividing the process into two steps separate from one another. Also in this case, it is preferred that the overall duration of the process lies between 10 seconds and 5 minutes, with the first process step being carried out within a maximum of 1/10 of the overall duration within tubing system 14.

Figure 3:
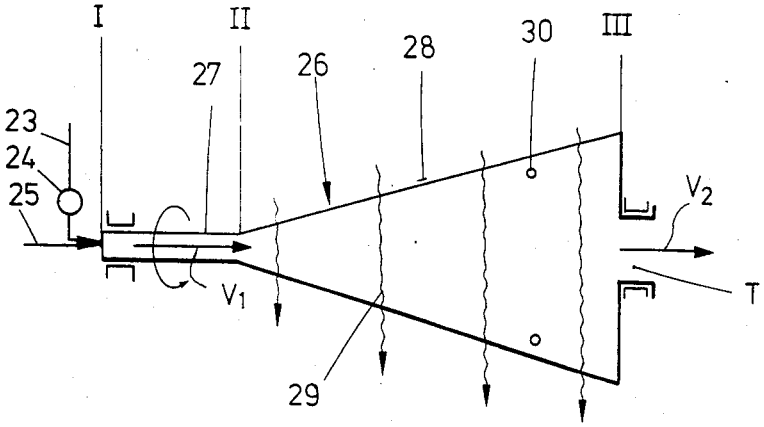
FIG. 3 is a schematic side elevational view of a drum dryer employing the principles according to the present invention.

FIG. 3 shows yet another embodiment of an apparatus for carrying out the method according to the present invention. The apparatus of FIG. 3 comprises a drum dryer 26 of conically divergent cross-sectional configuration, including an upstream narrower drying section 27 and a downstream section 28 of increasing cross-sectional area. Located at the inlet end I of drum dryer 26 is a tobacco feed duct 23 including a control device 24 the duct 23 being connected to a heating medium inlet duct 25 for conveying the tobacco through the drum dryer by means of the heating medium. The peripheral surface of drum dryer 26 is formed with fluid inlet openings 30, so that a stream of hot moist air may be blown through the drum dryer transversely of its longitudinal direction. In section 27, the mixture of heating medium and tobacco flows with a linear velocity V1, and from the end II of section 27 to the outlet end III of downstream section 28 with a reduced velocity V2, at which speed the tobacco is discharged from the drum dyer. In this case there is a continuous transition between the first and the second process step, although the tobacco is treated under different conditions in the two steps.

Figure 4:
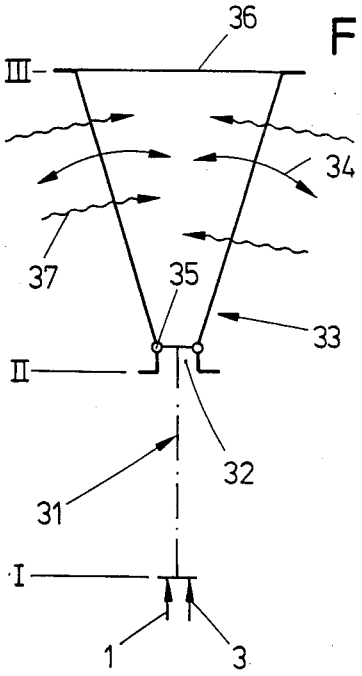
FIG. 4 is a plan view of a drying chute constructed according to the present invention.

FIG. 4 shows still a further embodiment of the apparatus for carrying out the method according to the present invention, wherein the upstream section 31 of the apparatus for carrying out the first process step is shown in phantom lines and extends between an inlet end I and an outlet end II, the latter also forming the inlet end of a drying apparatus 33. Connected to upstream section 31 is a tobacco feeding duct 1 and a heating medium inlet duct III. The drying apparatus is in the form a chute having an inlet 32 and an outlet 36. The cross-sectional area of the chute increases in the direction of flow. The sidewalls of the chute may be mounted in bearings 35 for pivotal movement in the directions of double arrows 34. Furthermore, the chute may be provided with heating and/or cooling means as indicated at 37.

Figure 5:
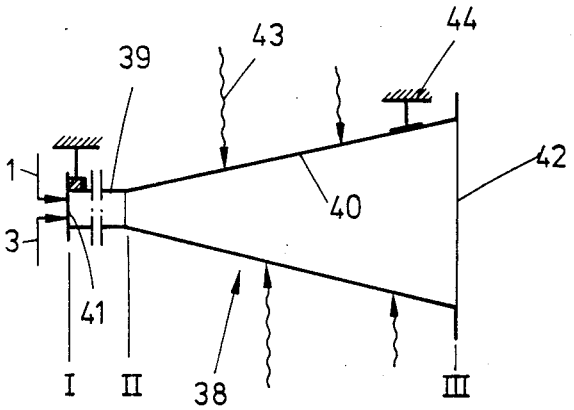
FIG. 5 is a side elevational view of a pneuma tube dryer embodying the principles of the present invention.

FIG. 5 shows another embodiment of an apparatus employing the method according to the present invention. In FIG. 5 the method is carried out in a stationary pneuma tube 38 having an upstream section 39 of constant cross-sectional area and a downstream section 40 of gradually increasing cross-sectional area. Connected to an inlet 41 of pneuma tube 38, and defined as station I, is a tobacco feeding duct 1 and a heating medium duct 3. The heating medium is effective to convey the tobacco in the longitudinal direction between stations I and II at such a speed that approximately 80% of the totally obtainable volume expansion occurs along this section. Between stations II and III, the latter being the outlet 42 of pneuma tube 38, there occurs the slower final volume expansion of the tobacco together with its drying to the desired final moisture content. The pneuma tube 38 may be cooled and/or heated as indicated at 43, and/or may be provided with inlet openings (not shown) into which a cooling or heating medium may be blown. The pneuma tube 38 is stationarily mounted as at 44.

Figure 6:
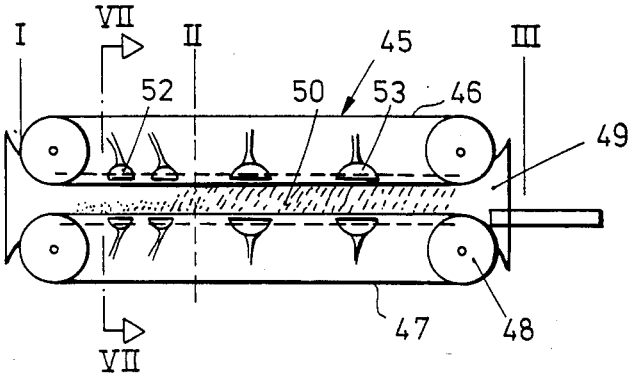
FIG. 6 is a schematic side elevational view of yet another embodiment of an apparatus employing the principles according to the present invention.
Figure 7:
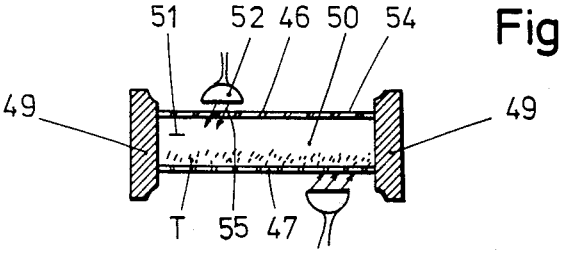
FIG. 7 is an enlarged sectional view taken substantially along line VII—VII in FIG. 6.

FIGS. 6 and 7 show yet another apparatus employing the process of the present invention. The apparatus 45 comprises two longitudinally movable mesh belts 46 and 47 guided over guide rollers 48. Between one another, the mesh belts define a tunnel 50 closed on both sides of mesh belts 46 and 47 by lateral sealing walls 49. The height or the interior width, respectively, of tunnel 50 is selected such that along an upstream section of apparatus 45 between stations I and II there is an air space 51 above the tobacco T lying on lower mesh belt 47 so as not to impair the volume expansion. Immediately to the rear of mesh belts 46 and 47, there are provided inlets 52 and 53 through which a heating medium is blown into tunnel 50 as indicated by arrows 55. Each mesh belt 46 and 47 has a plurality of openings 54. In the longitudinal direction, apparatus 45 is divided into a first section between stations I and II and a succeeding second section between stations II and III, these sections serving to carry out the first and second process steps respectively. The tobacco layer lying on lower mesh belt 47 may have a thickness between 2 and 20 cm.

In the first process step a hot steam-gas mixture having a temperature of about 240° C. is blown through inlets 52, preferably intermittently, at a relatively high speed of between 7 and 10 m/sec. In the second process step, i.e. in the section between stations II and III, a heating medium in the form of a steam-gas mixture having a lower steam content and a lower temperature of about 100–120° C. is blown through the apparatus at a reduced speed of not more than about 1 m/sec. In the section between stations I and II, the moist tobacco incurs about 80% of the possible total volume expansion due to the high flow velocity and the high temperature/steam content of the heating medium. In the section between stations II and III the volume-expanded tobacco is then dried to the desired final moisture content at a lower temperature and at a considerably reduced heating medium flow speed and at a reduced steam content thereof.

It is useful to puff with a heating medium having a temperature between 120° C. and about 300° C. In opposition to the previously described methods the overall duration of the method (puffing and drying) employing an apparatus as shown and described in FIGS. 6 and 7 can be reduced to about 6 seconds.

Characteristic temperature, velocity, and moisture values are indicated by way of the following examples in connection with the described apparatus.

EXAMPLES

Example I

A predetermined amount of rolled and cut Virginia stems was moistened in the usual manner to an initial moisture content of 60% by weight. The impregnated tobacco was conveyed from feeding duct 1 of the apparatus shown in FIG. 1 through tubing section 4 at a linear speed of 50 m/sec. by means of a heating medium consisting in this case of an air/water vapor mixture having a water vapor content of 80 volume percent. Adjacent inlet end I, the heating medium was at a temperature of 205° C. With the given cross-sectional area and the length (in this case 2 m) of the tubing system 4, the mixture required an average of 0.3 seconds to reach outlet end II. Approximately 80% of the volume expansion effect was accomplished during this period.

Adjacent the outlet end II, the moisture content of the tobacco was lowered to 48% by weight. In the drum dryer 8 the tobacco was then dried within 3 minutes at a temperature of 120°–140° C. to attain a final moisture content of 12–13 weight percent, the linear speed of the air/water vapor mixture being about 5 m/sec.

At the outlet end II of the tube system 4, the filling power of the tobacco, as measured with a Borgwaldt densimeter, had already been improved by an average of 47% over that of the untreated tobacco. Measurement of the improved filling capacity at IV showed an average value of 51%, with the final moisture content having been lowered to 13%.

A sieve analysis of the tobacco treated in accordance with the method of the invention resulted in an increase of 1.0 weight percent of fines passing through a 0.5 mm mesh sieve as compared to the untreated tobacco. In a smoking test the smoke of the treated tobacco was found slightly harsher than that of the untreated tobacco.

Example II

A predetermined amount of rolled and cut Maryland stems was treated in the following manner in the apparatus of FIG. 2. Initially the tobacco was impregnated in container 11 with an aqueous solution of sodium dihydrogen phosphate, resulting in an initial moisture content of 58 weight percent, with the sodium dihydrogen phosphate content being 1.2 weight percent as calculated on the dry weight of the tobacco.

By means of the heating medium admitted through duct 13, namely, an air/water vapor mixture at a temperature of 210° C., the tobacco was then conveyed through tubing system 14 toward separator 16. Subsequently, the tobacco was further treated in drying apparatus 19 by circulation therethrough of a heating medium in the form of an air/water vapor mixture at an average temperature of 130° C. In the tubing system between inlet I and outlet II, the average linear velocity was 55 m/sec. The average dwelling time of the tobacco in tubing system 14 was 0.4 seconds. Between stations II and III the tobacco retained a moisture content of 42% and already showed an improved filling capacity of 58%.

In drying apparatus 19, the heating medium flowed at a linear speed of 5 m/sec. The tobacco remained in the multiple-belt dryer for an average of 2.5 minutes and subsequently showed a final moisture content of 12.5% with a total improved filling capacity of 65%.

The smoking test did not show any difference in taste between the treated and untreated tobacco.

Example III

In the apparatus of FIG. 3 the method according to the invention was carried out with a mixture of cut tobacco leaves and cut tobacco stems adjusted in a conventional manner to an initial moisture content of 44%. The heating medium was then admitted through duct 23 to convey the tobacco from duct 23 into drum dryer 26, the cross-sectional area of which increased by a factor of about 3 from its upstream end to its downstream end. The average diameter of the drum dryer was between 1.2 and 1.5 meters.

Two examples of the impregnated tobacco were separately treated employing methods with different parameters to illustrate positive effects of the method according to the invention.

A first sample A was fed to the drum dryer at an air temperature of 180° C. adjacent inlet I and a linear velocity of 20 m/sec. At station III, the temperature was still at 120° C., and the linear velocity at 7 m/sec. An improved capacity of 32% was obtained.

A second sample B was introduced with an air temperature of 160° C. adjacent station I and at a linear velocity of 5 m/sec. Adjacent station III the air temperature was still at 130° C., while the linear speed had dropped 2 m/sec. In this case the filling capacity was improved by 8%.

COMPARISON EXAMPLE

A batch of cut Virginia tobacco stems was moistened to an initial moisture content of 60% by weight and was then conveyed through a smooth walled 12 m tube having several bends for space-saving reasons towards a cyclone separator by means of an air/water vapor mixture having an inlet temperature of 250° C. and flowing at a linear speed of 42 m/sec. The tobacco left the installation after a dwelling time of 2.5 seconds with a final moisture content of 8% by weight. The filling capacity was improved by 49% over that of untreated tobacco. The fines proportion in passing through a 0.5 mm mesh sieve showed an increase of 7% by weight over that of the untreated tobacco.

A smoking test showed smoke of the treated tobacco to be very harsh with reduced aroma as compared to that of the untreated tobacco.

It will be recognized that numerous modifications may be made to the present invention without departing from the spirit or scope thereof, the scope of the invention being defined by the following claims.

I claim:

1. A method for the volume-expansion of disintegrated tobacco, comprising impregnating said tobacco with an impregnating medium containing water to an initial moisture content of 35% by weight, and then subjecting said impregnated tobacco to a continuous two-step puffing process having an overall duration of at least ten seconds for reducing the moisture content of the tobacco to a final content of between 10 and 13% by weight, wherein the first step of said two-step process comprises puffing said tobacco under standard puffing conditions to achieve an initial puffing effect of at least 80% of that achieved by the entire two-step process, during which the moisture content of said tobacco is reduced by about 5–60% of its original value, and the second step of said two-step process comprises treating the puffed tobacco at a temperature below the puffing temperature used in the first step to reduce the moisture content of the tobacco to between 10 and 13% by weight.

2. A method according to claim 1, characterized in that in the first process step the linear velocity of the heating medium is maintained at about 7 to 70 m/sec.

3. A method according to claim 2, characterized in that in the second process step the linear velocity of the heating medium is reduced by about 10% to about 90% from the velocity in the first process step.

4. A method according to claim 3, characterized in that the first process step is carried out over a period of at most 1/10 of the overall duration of the method.

5. A method according to claim 4, characterized in that the impregnating medium is water.

6. A method according to claim 5, characterized in that the impregnating medium contains orthophosphoric acid and the sodium or ammonium salts thereof in an amount of 0.1% to 2.0% by weight as referred to the dry weight of the tobacco.

7. A method according to claim 5, characterized in that the impregnating medium contains about 1–3% by weight of aluminum sulphate as referred to the dry weight of the tobacco.

8. A method according to claim 5, characterized in that the temperature of the heating medium in the first process step is at least about 130° C. and not more than about 280° C.

9. A method according to claim 8, characterized in that the temperature of the heating medium is reduced in the second process step by at least about 10% and by not more than about 50% from the temperature in the first process step.

10. A method according to claim 9, characterized in that in the first process step the impregnated tobacco is conveyed by pneumatic means.

11. A method according to claim 10, characterized in that in the second process step the tobacco is conveyed by pneumatic means.

12. A method according to claim 10, characterized in that in the second process step the tobacco is mechanically conveyed.

13. A method according to claim 5, characterized in that the impregnating medium contains orthophosphoric acid and at least one of its sodium or ammonium salts and ammonium sulphate.

14. A method according to claim 2, characterized in that in the first process step the linear velocity of the heating medium is maintained at about 30 to about 60 m/sec.

15. A method according to claim 1, characterized in that in the first process step the impregnated tobacco is conveyed by mechanical means.

16. A method according to claim 1, characterized in that in the second process step the tobacco is conveyed by mechanical means.

17. A method according to claim 1, characterized in that in the second process step the linear velocity of the heating medium is reduced by about 10% to about 90% from the velocity in the first process step.

18. A method according to claim 1, characterized in that the first process step is carried out over a period of at most 1/10 of the overall duration of the method.

19. A method according to claim 18, characterized in that there is a continuous transition from the first to the second process step.

20. A method according to claim 18, characterized in that there is a discontinuous transition from the first to the second process step.

21. A method according to claim 18 characterized in that the overall duration of the process is at least 10 seconds and not more than about 5 minutes.

22. A method according to claim 21, characterized in that in the first process step the linear velocity of the heating medium is maintained at about 30 to about 60 m/sec.

23. A method according to claim 1, characterized in that the impregnating medium is water.

24. A method according to claim 23, characterized in that the impregnating medium contains orthophosphoric acid and at least one of its sodium or ammonium salts and ammonium sulphate.

25. A method according to claim 23, characterized in that the impregnating medium contains orthophosphoric acid and the sodium or ammonium salts thereof in an amount of 0.1% to 2.0% by weight as referred to the dry weight of the tobacco.

26. A method according to claim 23, characterized in that the impregnating medium contains about 1–3% by weight of aluminum sulphate as referred to the dry weight of the tobacco.

27. A method according to claim 1, characterized in that the temperature of the heating medium in the first process step is at least about 130° C. and not more than about 280° C.

28. A method according to claim 1, characterized in that the temperature of the heating medium is reduced in the second process step by at least about 10% and by not more than about 50% from the temperature in the first process step.

29. A method according to claim 28, characterized in that in the first process step the impregnated tobacco is conveyed by mechanical means.

30. A method according to claim 28, characterized in that in the second process step the tobacco is conveyed by mechanical means.

31. A method according to claim 1, characterized in that in the first process step the impregnated tobacco is conveyed by pneumatic means.

32. A method according to claim 1, characterized in that in the second process step the tobacco is conveyed by pneumatic means.

33. A method according to claim 1, characterized in that in the second process step the tobacco is mechanically conveyed.

34. A method according to claim 1, characterized in that there is a continuous transition from the first to the second process step.

35. A method according to claim 1, characterized in that there is a discontinuous transition from the first to the second process step.

36. A method according to claim 1, characterized in that the overall duration of the process is at least 10 seconds and not more than about 5 minutes.

37. Apparatus for the two-step volume-expansion of disintegrated tobacco, comprising a tubing system including at least one tube section for carrying out a first process step in which a heating medium and tobacco flow through said tube section, said tube section having a passage with a longitudinal length selected such that, depending on the linear velocity of the heating medium employed in said first process step, the dwelling time of the tobacco in said tubing system may be adjusted to no more than 1/10 of the overall duration of the two-step process, and means for drying said tobacco connected to said tubing system for carrying out a second process step of drying said tobacco leaving said tubing system.

38. Apparatus according to claim 37, wherein the tubing system has interior walls provided with rounded elevations or chicanes extending at least approximately transversely of the direction of movement of the tobacco through the tubing system.

39. Apparatus according to claim 38, wherein said drying means is a multiple belt dryer including double mesh belts and a heating medium circulation system.

40. Apparatus according to claim 38, wherein said drying means has an inlet connected to said tubing system, and a separator device positioned between said tubing system and the inlet end of said drying means functioning as a discontinuous transition between the tubing system where the first process step is carried out and the drying means where the second process step is carried out.

41. Apparatus according to claim 38, wherein said drying means has a transition piece with increasing cross-sectional area connected to said tubing system.

42. Apparatus according to claim 41, wherein said drying means comprises a heatable or coolable chute of increasing cross-sectional area, the cross-sectional area increase of which is adjustable in a continuous manner.

43. Apparatus according to claim 42, wherein said drying means is a drum dryer.

44. Apparatus according to claim 37, wherein said drying means has a transition piece with increasing cross-sectional area connected to said tubing system.

45. Apparatus according to claim 37, wherein said drying means comprises a heatable or coolable chute of increasing cross-sectional area, the increasing cross-sectional area being adjustable in a continuous manner.

46. Apparatus according to claim 37, wherein said drying means is a drum dryer.

47. Apparatus according to claim 37, wherein said drying means is a multiple belt dryer including double mesh belts and a heating medium circulation system.

48. Apparatus according to claim 37, wherein said drying means has an inlet connected to said tubing system, and a separator device positioned between said tubing system and the inlet end of said drying means functioning as a discontinuous transition between the tubing system where the first process step is carried out and the drying means where the second process step is carried out.

49. Apparatus for the two-step volume-expansion of disintegrated tobacco comprising a drum dryer having an increasing cross-sectional area in one longitudinal direction, means for creating a flow of a heating medium through said dryer in said one direction, and means for moving said tobacco through said dryer in said one direction.

50. Apparatus according to claim 49 wherein said drum dryer has a plurality of inlet openings, and means for providing a uniform flow of heated and moist air transverse to said longitudinal direction through said openings.

51. Apparatus according to claim 49, wherein said drum dryer has an inlet end and an outlet end, and said cross-sectional area of said drum dryer increases by a factor of about 3 from the inlet end to the outlet end.

52. Apparatus according to claim 50, wherein said drum dryer has an inlet end and an outlet end, and said cross-sectional area of said drum dryer increases by a factor of about 3 from the inlet end to the outlet end.

53. Apparatus for the two-step volume-expansion of disintegrated tobacco, comprising upper and lower mesh belts, and a pair of lateral sides adjacent said mesh belts defining a longitudinally extending laterally closed tunnel having an entrance and an exit with first and second longitudinal portions therebetween, said mesh belts rolling from said entrance towards said exit, first heating medium inlet means above and below said first portion of said tunnel for blowing a first heating medium through the mesh belts at a first velocity and a first temperature through tobacco which has been poured on said lower mesh belt at said entrance and is moving through said first portion towards said exit, said first heating medium having a first gas-water vapor mixture, and a second heating medium inlet means above and below said second portion of said tunnel for blowing a second heating medium through the mesh belts at a second velocity lower than said first velocity and at a second temperature lower than said first temperature through tobacco leaving said first portion and moving towards said exit, said second heating medium having a second gas-water vapor mixture with a lower vapor content then said first gas-water mixture.

54. Apparatus for the two-step volume-expansion of disintegrated tobacco comprising a stationary pneuma tube having a first tube section of substantially constant cross-sectional area and a second tube section of increasing cross-sectional area, and means for varying the temperature of said pneuma tube.

55. A method for the volume-expansion of disintegrated tobacco, comprising impregnating said tobacco with an impregnating medium containing water to an initial moisture content of about 35% by weight and then subjecting said impregnated tobacco to a continuous two-step puffing process having an overall duration of at least 6 seconds for reducing the moisture content of the tobacco to a final content of between about 10% and about 13% by weight with the aid of a heating medium with a temperature of about 120° C. to about 300° C. and containing gaseous water vapor, wherein the first step of said two-step process comprises puffing said tobacco under standard puffing conditions to achieve an initial puffing effect of at least 80% of that achieved by the entire two-step process during which the moisture content of said tobacco is reduced by about 5% to about 60% of its original value, and the second step of said two-step process comprises treating the puffed tobacco at a temperature below the puffing temperature used in the first step to reduce the moisture content of the tobacco to between about 10% and about 13% by weight.

* * * * *